US006223482B1

(12) United States Patent
Zohar

(10) Patent No.: US 6,223,482 B1
(45) Date of Patent: May 1, 2001

(54) PORTABLE, EASILY COMPOSABLE SUPPORTING SKELETON

(76) Inventor: Herman Zohar, Borova vas 30, 2000 Maribor (SI)

( * ) Notice: Subject to any disclaimer, the term of this patent is extended or adjusted under 35 U.S.C. 154(b) by 0 days.

(21) Appl. No.: 09/043,309

(22) PCT Filed: Aug. 13, 1996

(86) PCT No.: PCT/SI96/00020

§ 371 Date: Feb. 17, 1998

§ 102(e) Date: Feb. 17, 1998

(87) PCT Pub. No.: WO97/07299

PCT Pub. Date: Feb. 27, 1997

(30) Foreign Application Priority Data

Aug. 17, 1995 (SI) ..... 9500261
Jul. 17, 1996 (SI) ..... 9600226

(51) Int. Cl.[7] ..... E04H 12/18

(52) U.S. Cl. ..... 52/109; 52/645; 52/655.1; 74/521; 135/131; 135/145; 248/277.1; 403/217

(58) Field of Search ..... 52/109, 645, 646, 52/655.1; 74/521; 135/131, 145, 147; 248/277.1; 403/170, 192, 217

(56) References Cited

U.S. PATENT DOCUMENTS 3,375,624 4/1968 Mikulin .
3,381,923 * 5/1968 Berry ..... 52/109 X
4,161,088 7/1979 Gugliotta et al. .
4,322,176 * 3/1982 Johnson, Jr. ..... 403/219
4,512,097 * 4/1985 Zeigler ..... 52/109 X
4,580,375 * 4/1986 Nodskov et al. ..... 52/109
4,589,236 * 5/1986 McAllister ..... 52/109 X
4,663,899 * 5/1987 Nodskov et al. ..... 52/109
4,846,204 7/1989 Kyu .
4,995,212 * 2/1991 Morgan et al. ..... 52/646
5,046,883 9/1991 Ezra .

FOREIGN PATENT DOCUMENTS 0271088 6/1988 (EP) .

* cited by examiner

*Primary Examiner*—Carl D. Friedman
*Assistant Examiner*—Kevin D. Wilkens
(74) *Attorney, Agent, or Firm*—Factor & Partners, LLC

(57) ABSTRACT

A portable, easily composable supporting skeleton which serves as a supporting structure of buildings composable in situ. The skeleton comprises a pipe-like spacer. Two dismountable node plates can be fixed to the spacer by way of clamping assemblies. Each node plate includes an eye having a through-hole. A joint assembly which comprises a crosswise tie-piece can be interconnected pivotably to the through-hole of the eye of one of the node plates.

16 Claims, 3 Drawing Sheets

PORTABLE, EASILY COMPOSABLE SUPPORTING SKELETON

BACKGROUND OF THE INVENTION

The invention relates to a portable, easily composable supporting skeleton which serves preferably as a supporting structure of buildings composable in situ and their components, especially roof tosses of provisionally erected buildings, tents, sports facilities, exhibition grounds, scenographies and even bridges and/or similar structures.

According to the International Patent Classification ($IPC^6$) the inventions of this kind are classified into the field of three dimensional framework structures (E 04 B 1/19) or into the field of construction elements consisting of bar-shaped building elements (E 04 B 1/58) or also in the field of connections between individual parts of skeletons used in construction (E 04 G 7/00).

The invention is based on the problem how to conceive the simplest possible skeleton of interconnected bar-shaped elements, in which as many skeleton components as possible remain interconnected also when in a partly disassembled state, foreseen, for example, for transport or storage, which will result in the smallest possible volume required by the skeleton when transported or stored; on the other hand the skeleton should be quickly and easily composable in situ, without any special accessories and in the shortest possible time.

In the DE 38 00 547 A1 the so called set of building elements for framework structures is described, which consists essentially of cylindrical node elements with longitudinal running grooves arranged uniformly over their circumference. The grooves are intended for the insertion of preferably pipe-like supporting rods with adequately reinforced ends. Such a set represents no doubt a relatively simply composable supporting structure which can be erected stepwise into a rod assembly or a suitable skeleton, and then also disassembled, always in situ. From an overall viewpoint the individual component parts require during transport and storage relatively small room with respect to the dimensions of the entire skeleton. However, this type of structure is deficient, among other reasons also because of the possibility that individual component parts easily get lost or are mislaid during the disassemblage and assemblage, which often causes delays in fulfilling obligations, or leads even to improvisations, which, as a rule, mean a substantial reduction of the bearing capacity of the entire skeleton. Besides, it shall be added, that the stepwise assemblage of a skeleton is a time-consuming job. Each individual rod shall be screwed one by one into the adequate joint elements. Besides, the screwing has to be performed in different positions, at different angles and even in high positions. It often happens, that the rods with the male thread are damaged during transportation, the threads are namely smashed, which can essentially render difficult and extend the assemblage of the structure. Similarly, e.g. due to dirt, especially in assembling in the field, e.g. in situ, some of female threads in the node element can be damaged, too. This kind of inconvenience is extremely difficult to eliminate, for cleaning of inner threads is a complicated procedure; therefore, it often occurs in practice, that rods are screwed forcibly in inadequately cleaned openings. Such procedures almost surely lead to the destruction of at least one thread in the node element, which means in general, that the node element as a universal unit is no longer usable.

A similarly conceived solution is known also from PCT/HU90/00015, in which the node element shaped like an octahedron, icosahedron or similar multiangular solid is enclosed with a sort of envelope by means of which the screw heads are tightened to the node element; then it is possible to screw the rods with thread openings at their ends on the screw stems. The problems arisings with this invention are very similar to those occuring with the invention according to the before mentioned solution described in the DE 38 00 547 A1.

SUMMARY OF THE INVENTION

The present invention relates to a portable, easily composable supporting skeleton which is, in general, embodied as a space rod assembly, composable, or decomposable in situ and consisting of interconnected crosswise tie-pieces.

The skeleton according to the invention comprises in general at least one pipe-like spacer, to the ends of which two dismountable node plates having a centrally placed openings can be fixed, each by itself, by means of a clamping assembly. In addition, each of the plates is equipped also with eyes, each of which has a through-hole. To the eyes on both node plates of the same spacer, one joint assembly consisting of crosswise tie-pieces interconnected pivotably can be preferably added.

The said clamping assembly of the skeleton according to the invention consists of a bolt, inserted through the spacer and through the central through-holes of the pertaining node plates. On the thread ends of the bolt two nuts are screwed, if necessary, by which the node plates are clamped to the spacer. In the alternative embodiment of the skeleton according to the invention the clamping assembly consists of thread triggers placed in the interior of the pipe-like spacer, embodied in this case with two transverse holes. Each of said thread triggers has a spring and also a transversely running locking pin which in the adequate position can be catched by means of the appropriate spring in the belonging transverse hole of the spacer.

Furthermore, the skeleton according to the invention can comprise also additional reinforcing longitudinal tie-pieces, each of which is placed over the belonging node plates and which can be clamped to the spacer by means of in any case foreseen nuts together with the node plates.

In addition to that, the node plate with the central through-hole being the part of the skeleton according to the invention, is preferably embodied in such a way, that it comprises pairs of eyes uniformly arranged over its circumference. Each of the eyes has one circular through-hole, in which the through-holes of both eyes of each pair of eyes are co-axial. By the most preferable embodiment of the invention, the node plate comprises four pairs of eyes which are arranged in such a way, that the axes of their through-holes form a square. In general, the node plate can be equipped, besides with the eyes, also with hinges.

As said before, the skeleton according to the invention is characterized by that, that the joint assembly consists of two pivotably interconnected, crosswise placed tie-pieces, and is thus in fact shears-like embodied; said tie-pieces are entirely connected each to another, however, the angle between them can be optionally changeable, i.e adjustable. Hereby, each of the said tie-pieces has on each of its ends at least one through-hole, which is placed in such a position, that the fastening of the tie-piece to each belonging eye of the node plate is enabled, namely in such a way, that a screw or, if necessary, also some other appropriate fastening element can be placed through each hole of the tie-piece, and on the other hand also through each of the belonging eyes of the node plate.

Although the joint assembly of the skeleton according to the invention can, in general, consist of homogeneus, pivotably interconnected and crosswise arranged tie-pices, however, in certain cases, even in preferable examples, at least one of the tie-pices can be embodied also as a non-homogeneus one, i.e. consisting of more parts. In one of the preferable embodiments of the skeleton according to the invention, the joint assembly is made of a homogeneus tie-pice which is enclosed with one part of the double tie-piece on each side. In this case both parts of the double tie-piece are in essence at least parallel to each other and placed crosswise with the said homogeneus tie-piece.

The skeleton according to the invention will be described in detail on the basis of embodiments presented in the attached drawings showing thereby

BEST MODE FOR PRACTICING THE INVENTION

Figure 1:
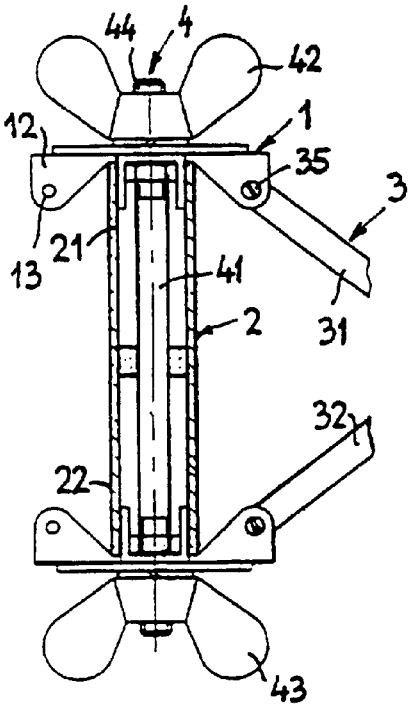
FIG. 1 the first embodiment of the skeleton according to the invention in a partial longitudinal section and front elevation.
Figure 2:
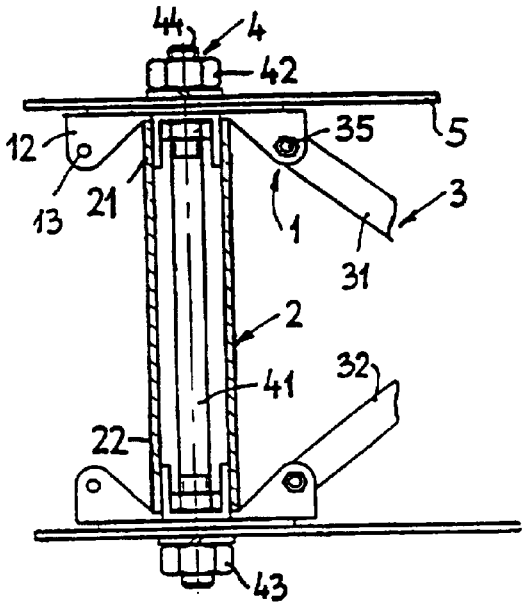
FIG. 2 a further embodiment of the skeleton according to the invention, also in a partial longitudinal section and front elevation.
Figure 3:
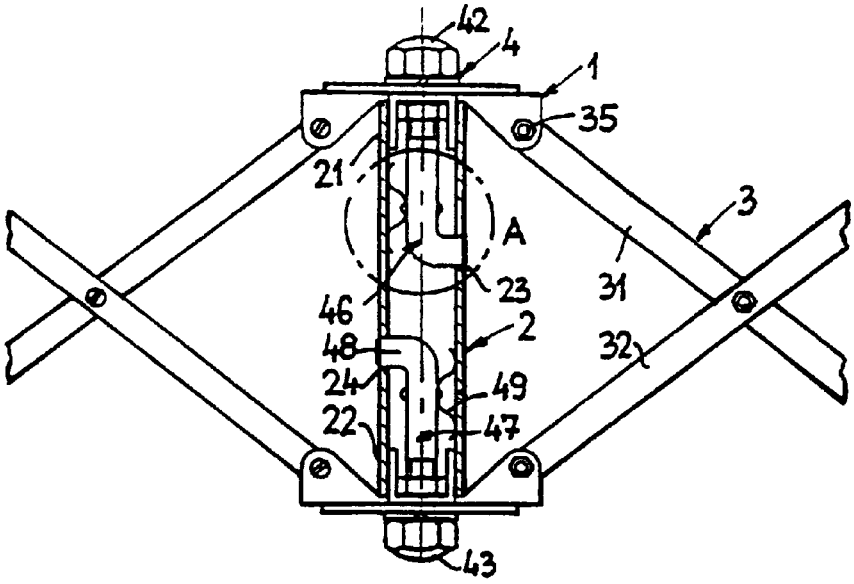
FIG. 3 another embodiment of the skeleton, also in a partial longitudinal section and front elevation.

As shown in FIGS. 1–3, the skeleton according to the inventionm consists of the node plates 1, arranged on both ends 21, 22 of the pipe-like spacer 2 and of the joint assemblies 3 of crosswise tie-pieces 31, 32, interconnected by means of hinges, the joint assemblies 3 being clamped to the spacer 2 by means of the clamping assembly 4, as well as connected preferably pivotable to each node plate 1.

In this case the spacer 2 is preferably embodied as a pipe, the most preferably as a square pipe. The clamping assembly 4 which in preferable embodiment according to FIGS. 1 and 2 consists of a bolt 41 and nuts 42, 43, screwed on its threaded ends 44, 45, is inserted in a longitudinal direction through the spacer 2. The nuts 42, 43 are embodied either as wing nuts (FIG. 1) or common used hexagonal nuts (FIG. 2), moreover as castle nuts (FIG. 3) or any other type of nuts being useful for screwing on the thread ends 44, 45 of an ordinary and common used stay-bolt.

In the alternative embodiment of the skeleton as shown in FIG. 3, two threaded triggers 46, 47 which can be longitudinally moved in the interior of the spacer 2, are used instead of the bolt 41. In this case the spacer 2 is equipped with at least two transverse holes 23, 24. Each of the triggers 46,47 comprises a locking pin 48 running transversely with regard to the spacer 2, and with spring 49 by means of which the locking pin 48 can be placed when in a certain position, into the belonging transverse hole 23, 24 of the spacer 2.

Figure 4:
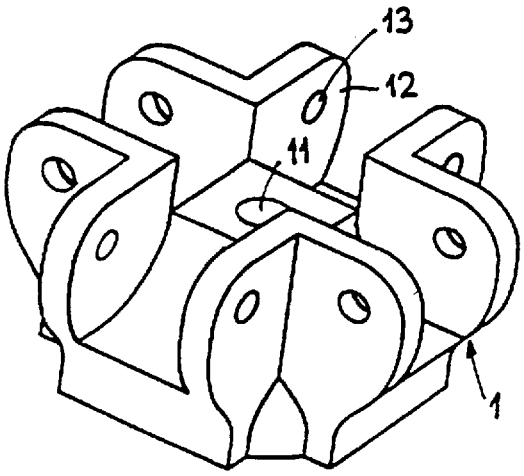
FIG. 4 the skeleton node plate, in perspective.
Figure 5:
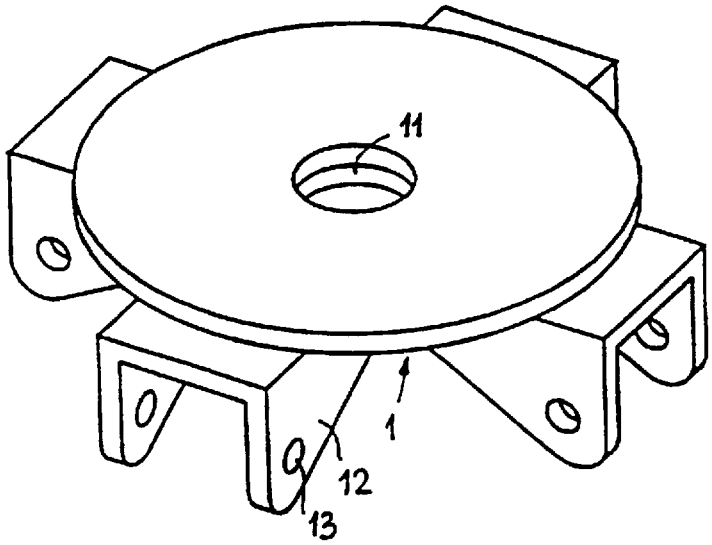
FIG. 5 the skeleton node plate according to FIG. 4 with some modifications, in a view from the other side, also in perspective.

Each node plate 1 is equipped with a central through-hole 11 and eyes 12. Each of the eyes 12 is adapted in such a way, that it can accept one of the crosswise tie-pieces 31, 32 of the joint assembly 3, interconnected pivotably, and each eye 12 is equipped with an adequate through-hole 13 for this very purpose. Each eye 12 is preferably embodied as a double eye consisting of equal in parallelly to each other arranged eyes 12, the through-holes 13 of which are co-axial. In this case there can be one, two or more eyes 12 arranged on the plate 1. The most preferable embodiment (FIGS. 4–6) is that, when each of the plates 1 comprises four double eyes 12 with through-holes 13, the axes of which are arranged in such a way, that they form a square.

Figure 6:
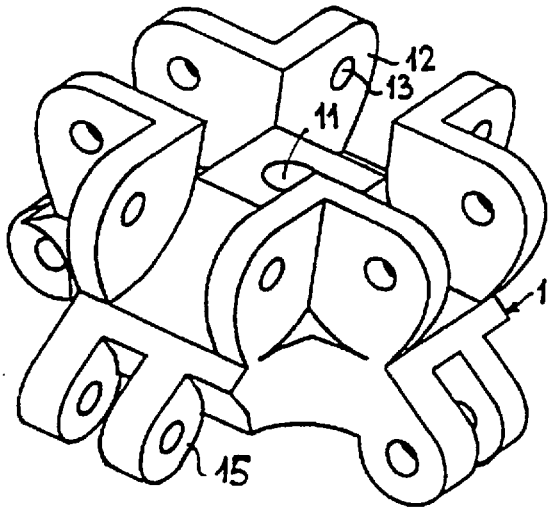
FIG. 6 an alternative embodiment of the node plate of the skeleton according to the invention.

In addition to that, as shown in FIG. 6 presenting the alterative embodiment of the plate 1, any plate 1 can be equipped also with some additional elements. In this case the plate 1 is equipped with hinges 15 intended for the fastening of particular parts or assemblies; these parts or assemblies should be, in certain cases—according to the needs of the user, additionally fixed to the skeleton according to the invention. In the embodiment according to FIG. 6 the hinges 15 are arranged in completely the same as the eyes 12.

Figure 7:
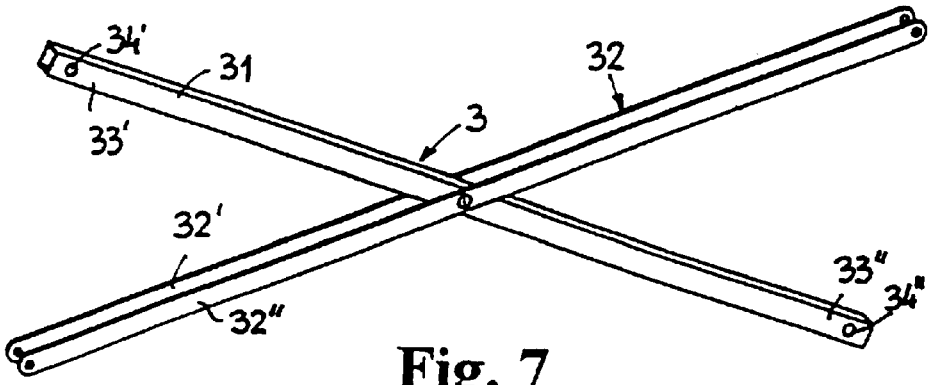
FIG. 7 the assembly of crosswise interconnected tie-pieces, in perspective.
Figure 8:
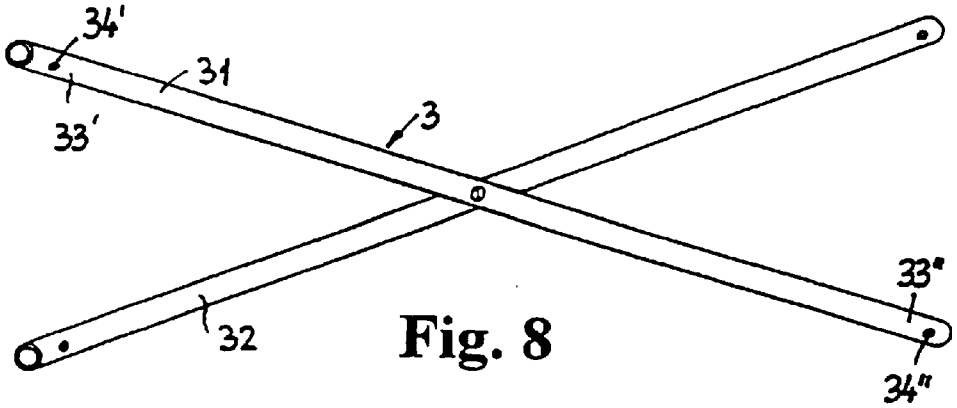
FIG. 8 a further embodiment example of the assembly of crosswise interconnected tie-pieces, also in perspective.
Figure 9:
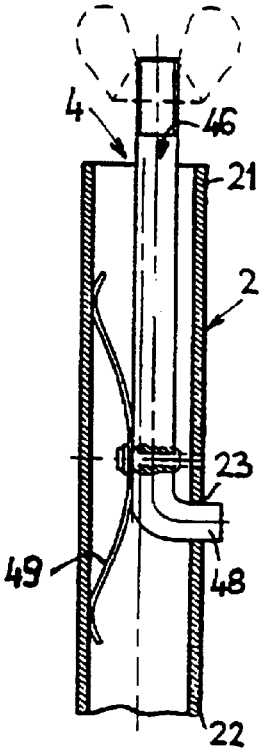
FIG. 9 detail A according to FIG. 3.

Any assembly 3 of the crosswise tie-pieces 31, 32 connected pivotably, consists of two tie-pieces 31, 32 which are either uniform (FIG. 8), or any of the tie-pieces 31, 32 can be also embodied in some other way, e.g. as a double tie-piece (FIG. 7). In general, the tie-pieces 31, 32 are interconnected pivotably and arranged crosswise, so that a kind of shears conception of the tie-pieces 31, 32 is obtained. This type of conception enables folding and stretching of the tie-pieces 31, 32, i.e. setting the tie-pieces 31, 32 into different position with regard to the angle $\alpha$, which is formed between the tie-pieces 31, 32. In all the cases any of the tie-pieces 31, 32 is equipped at their ends 33', 33" with at least one through-hole 34', 34". This enables the fastening of the tie-pieces 31, 32 to the belonging eye 12. The most usual fastening is by means of the screw 35 which runs through the whole 34', 34" of each tie-piece 31, 32 and at the same time also through the hole 13 of the belonging eye 12 of each node plate 1 of the skeleton according to the invention.

In the case, when the tie-pieces 31, 32 are embodied as uniform tie-pieces, they can be made of e.g. round pipes (FIG. 8) or other semi-finished products consisting of materials which meets the requirements of this specific application purpose. Especially from the viewpoint of the distribution of loadings, it can be in many cases preferable, if at least one of the tie-pieces 31, 32 is embodied as an uniform tie-piece, while the other as a double tie-piece (FIG. 7). In this case the uniform tie-piece 31 is embodied e.g. as a square pipe, enclosed on each side with one element 32', 32" of the double tie-piece 32. In this case the tie-pieces 31, 32—as well as in any other case—are equipped at their ends 33', 33" with the through-holes 34', 34" and each of them is separately connected to the belonging eye 12 of each node plate 1 of the assembly according to the invention.

In general, the skeleton according to the invention comprises a multitude, or in other words a field of spacers 2 arranged uniformly among themselves in the longitudinal and transverse direction. The two node plates 1 are clamped to each of the spacers 2 by means of the clamping assembly 4. In each case one of the crosswise tie-pieces 31, 32 of the assembly 3 is fixed to each of the eyes 12 of the said node plates 1, in such a way, that each of the tie-pieces 31, 32 of any assembly 3 is fixed to its own node plate 1 of the same spacer 2. With an appropriate selection of materials and dimensions of particular parts, the skeleton obtained in this way is embodied as a space structure, a sort of modified space rod-assembly which is characterized by its high bearing capacity and extreme stability.

The bearing capacity of the skeleton can be, in general, additionally increased, if (FIG. 2) additional longitudinal tie-pieces 5 are fixed to the spacer 2 with clamping assemblies 4. In the most preferable case the tie-pieces 5 are placed over the node plates 1, so that each tie-piece 5 is clamped to the belonging node plate 1 with the corresponding nut 42, 43 of the clamping assembly 4 and so indirectly also to the belonging spacer 2 of the skeleton according to the invention.

The possibility of changing the mutual position of the crosswise tie-pieces 31, 32 of the joint assemblies 3 is obtained by a mere stretching of the clamping assembly 4. The shears-like stretching and folding of the tie-pieces 31, 32 means, in general, a change of the overall volume. In this way it is possible to ensure the storage of the skeleton in a relatively small room, when the skeleton is not used or during its transportation.

When the skeleton is to be assembled into a supporting structure, it is stretched, i.e. the joint assemblies 3 are extended in such a way, that the tie-pieces 31, 32 are stretched in an adequate mutual position, the node plates 1 shall rest adequately on the spacers 2 and after this, the node plates 1 shall be clamped to the spacers 2 by means of the clamping assemblies 4, i.e. concretely the nuts 42, 43.

By means of this type of the embodiment a simple skeleton has been realized, in which a great deal of its components are connected between themselves, while it assumes the least possible volume during transportation or storage. Besides—and it can be in some cases even the most important thing—this type of skeleton can be easily and simply assembled, without any special accessories, in situ or on the spot and in the shortest possible time.

What is claimed is:

1. A portable, easily composable supporting skeleton apparatus, which is embodied as a space framework assembly composable and decomposable comprising:

at least one pipe-like spacer having two ends;

a node plate associated with each of the two ends, each node plate having a central through-hole and including at least one eye, and a through-hole extending through the at least one eye; and a clamping assembly, the clamping assembly comprising:

a bolt having two ends, the bolt extending through the pipe-like spacer and through the central through-hole extending through each node plate; and a nut threadedly engaged with each of the two ends of the bolt.

2. The apparatus of claim 1 further comprising at least one pair of longitudinal tie pieces clamped to the spacer by way of at least one of the threadedly engaged nuts.

3. The apparatus of claim 1 wherein the at least one eye of at least one of the node plates comprises two spaced apart eyes, each eye having a through-hole positioned such that the through-holes of each of the eyes is coaxial.

4. The apparatus of claim 1 wherein the at least one eye of at least one of the node plates comprises two pairs of spaced apart eyes, each eye having a through-hole positioned such that through-hole of each of the eyes of each pair is coaxial.

5. The apparatus of claim 1 wherein at least one of the node plates further includes at least one hinge.

6. The apparatus of claim 1 further comprising:

a joint assembly having at least two interconnected tie-pieces wherein the tie pieces are rotatably connected to each other.

7. The apparatus of claim 6 wherein at least one of the at least two interconnected tie-pieces includes a through-hole operably positionable into alignment with the at least one through-hole of the at least one eye of at least one of the node plates.

8. The apparatus of claim 6 wherein one of the at least two interconnected tie pieces comprises two components.

9. A portable, easily composable supporting skeleton apparatus, which is embodied as a space framework assembly composable and decomposable comprising:

at least one pipe-like spacer having two ends and two transverse holes;

a node plate associated with each of the two ends, each node plate having a central through-hole and including at least one eye, and a through-hole extending through the at least one eye; and a clamping assembly, the clamping assembly comprising:

a pair of locking pins, each locking pin having a spring and a transversely running portion, the transversely running portions of each engaging a respective transverse hole and a portion of the locking pin extending through the pipe-like spacer and through the central through-hole extending through the respective node plate, wherein the spring maintains the transverse running portion engaged with the respective transverse hole; and a nut threadedly engaged with each of the two ends of the bolt.

10. The apparatus of claim 9 further comprising at least one pair of longitudinal tie pieces clamped to the spacer by way of at least one of the threadedly engaged nuts.

11. The apparatus of claim 9 wherein the at least one eye of at least one of the node plates comprises two spaced apart eyes, each eye having a through-hole positioned such that the through-holes of each of the eyes is coaxial.

12. The apparatus of claim 9 wherein the at least one eye of at least one of the node plates comprises two pairs of spaced apart eyes, each eye having a through-hole positioned such that through-hole of each of the eyes of each pair is coaxial.

13. The apparatus of claim 9 wherein at least one of the node plates further includes at least one hinge.

14. The apparatus of claim 9 further comprising:

a joint assembly having at least two interconnected tie-pieces wherein the tie pieces are rotatably connected to each other.

15. The apparatus of claim 14 wherein at least one of the at least two interconnected tie-pieces includes a through-hole operably positionable into alignment with the at least one through-hole of the at least one eye of at least one of the node plates.

16. The apparatus of claim 14 wherein one of the at least two interconnected tie pieces comprises two components.

* * * * *